United States Patent [19]

Sanfilippo

[11] Patent Number: 4,658,566

[45] Date of Patent: Apr. 21, 1987

[54] APPARATUS AND METHOD FOR SEALING CONTAINERS IN CONTROLLED ENVIRONMENTS

[76] Inventor: John E. Sanfilippo, Plum Tree Rd., Box 367, Barrington Hills, Ill. 60010

[21] Appl. No.: 818,386

[22] Filed: Jan. 13, 1986

Related U.S. Application Data

[63] Continuation-in-part of Ser. No. 705,661, Feb. 26, 1985, abandoned.

[51] Int. Cl.[4] ..... B65B 31/02

[52] U.S. Cl. ..... 53/432; 53/510

[58] Field of Search ..... 53/79, 91, 95, 96, 97, 53/99, 101, 328, 276, 272, 403, 405, 432, 510, 511, 560; 141/65; 198/481; 414/217

[56] References Cited

U.S. PATENT DOCUMENTS

| | | | |
|---|---|---|---|
| 1,589,452 | 6/1926 | Bach . | |
| 1,726,766 | 9/1929 | Rector . | |
| 1,751,643 | 3/1930 | Malmquist . | |
| 1,774,529 | 9/1930 | Sharp . | |
| 2,095,960 | 10/1937 | Bach . | |
| 2,292,887 | 8/1942 | McBean . | |
| 2,295,692 | 9/1942 | Sanfranski et al. | 53/101 |
| 2,363,704 | 11/1944 | Stover . | |
| 2,380,903 | 7/1945 | Ray | 53/405 |
| 2,457,690 | 12/1948 | Kronquest . | |
| 2,521,746 | 9/1950 | Preis . | |
| 2,760,702 | 8/1956 | Pechy . | |
| 2,795,090 | 6/1957 | Sterna | 198/481 |
| 3,135,303 | 6/1964 | Gordon et al. | 53/95 |
| 3,250,213 | 5/1966 | Brigham et al. | 198/481 |
| 3,363,741 | 1/1968 | Dierksheide | 198/481 |

OTHER PUBLICATIONS

Promotional Literature, Owens-Illinois, Series 73-200, 20-Head Vacuum Capper.

Promotional Literature, Calumatic Dry Vacuum System, Calumatic Mechanical Vacuum System, White Cap Division, Continental.

Literature, Single Bell Machine, White Cap Company, (1952-53).

*Primary Examiner*—John Sipos
*Assistant Examiner*—Donald R. Studebaker
*Attorney, Agent, or Firm*—Willian Brinks Olds Hofer Gilson & Lione Ltd.

[57] ABSTRACT

An improved method and apparatus for sealing jars and other containers within specialized environments, such as a vacuum, is provided. The containers are introduced into chambers of a rotary drum, and an outer enclosure for the drum is provided by means of a substantially flexible moving belt which conforms to the periphery of the drum and seals the chambers. A vacuum may then be introduced to the chamber to evacuate the interior of the container, and the lid of the container may then be secured to maintain the desired vacuum within the container. The flexible belt may move in synchrony with the rotation of the drum, eliminating relative motion between the outer enclosure and the drum and avoiding need for complex sliding seals. The device is quickly adaptable to sealing and closing numerous configurations and sizes of containers.

21 Claims, 11 Drawing Figures

APPARATUS AND METHOD FOR SEALING CONTAINERS IN CONTROLLED ENVIRONMENTS

This application is a continuation-in-part of application Ser. No. 06/705,661, filed on Feb. 26, 1985 now aband.

TECHNICAL FIELD

The invention relates to a method and apparatus for sequentially exposing objects to a controlled environment. More particularly, the invention relates to a vacuum jar closer and method for vacuum sealing containers which uses a moving, substantially continously flexible belt to seal the periphery of a rotary chambered drum, thereby defining individual closed chambers.

BACKGROUND OF THE INVENTION

In many industries it is necessary or desirable to sequentially expose individual articles to specialized controlled environments. For example, in the food packaging industry several methods and devices exist for sequentially exposing containers of food products to a vacuum or to an inert atmosphere, and for sealing the container to retain the applied vacuum or atmosphere and thereby preserve freshness of the food products.

One technique for supplying a controlled environment utilizes individual "bell jar" enclosures which surround the container. Such a device is disclosed, for example, by U.S. Pat. No. 2,292,887 issued to McBean. Although such devices may be adapted for continuous operation, the apparatus necessary for moving the container and/or the "bell jar" relative to one another adds considerable complexity and cost to the device.

Other devices are known which cooperate directly with the opening of the container to apply, for example, a vacuum substantially to the interior of the container only. U.S. Pat. No. 2,457,690 issued to Kronquest discloses an example of such a vacuum-head apparatus. Such devices, however, are complex, and are not readily adaptable to use with containers having differing configurations and sizes.

It is further known to utilize a multi-chambered rotary drum, in which individual chambers may accept a container to be subjected to the controlled environment or vacuum. As the drum rotates, the chambers transporting the containers move past and engage and outer enclosure which seals the opening of the chamber, and a vacuum is applied. The container is then sealed, normal atmosphere is returned to the chamber, and the drum rotates past the enclosure so that the sealed container may be removed. U.S. Pat. Nos. 1,751,643 issued to Malmquist, 2,521,746 issued to Preis, and 1,774,529 issued to Sharp illustrate various configurations of such known devices.

Unfortunately, previous rotary drum devices have suffered from several shortcomings which limit their usefulness. For example, tolerances between the surface of the rotary drum and the outer enclosure must be very close in order to prevent excess leakage between the outer atmosphere and the enclosed inner chamber and controlled environment. The interface between the moving drum and the stationary enclosure is subject to wear and introduces considerable friction which must be overcome to rotate the drum. These problems are increased when a vacuum is applied to the chambers of the drum, for the pressure of the atmosphere on the outside of the stationary enclosure increases the frictional contact with the rotary drum. Such pressure may also distort the enclosure and interfere with a good vacuum seal.

Various configurations of rotary drums and enclosures have been utilized in attempts to minimize these difficulties, including specialized gaskets, sliding seals, and bearings described in the prior art. However, such attempts have been largely unsuccessful, and have added to expense and complexity which reduces reliability.

Further, prior systems have not been readily adaptable to accommodate numerous configurations and sizes of containers. As a result, it has been difficult or impossible to utilize a single device in conjunction with differing sizes or shapes of containers without extended down-time for reconfiguration of the system.

Accordingly, it is an object of the present invention to provide a rotary drum sealing device and method which provide a secure closure of desired individual chambers during rotation of the drum without significantly interfering with such rotation. A related object is to provide such a method and apparatus which do not introduce significant friction between the sealing enclosure and the rotating drum.

A further object is to provide a rotating drum vacuum sealing apparatus and method which eliminate the need for sliding seals.

An important object of the present invention is to provide a rotary drum vacuum sealing apparatus and method for use in a continuous sealing operation, which is mechanically simple, having few components, and which is therefore economical and highly reliable.

Another object is to provide such a sealing apparatus which is readily adaptable for use with varying sizes and configurations of jars and other containers. A related object is to provide such a device including means for closing the container which is adaptable to differing heights of containers. A further related object is to provide such a system adapted for receiving containers of differing diameters.

These and other objects shall be apparent in light of the present specification.

BRIEF SUMMARY OF THE INVENTION

In order to achieve the object of the invention and to overcome the problems of the prior art, the device and method of the present invention utilize a flexible member, such as a plastic or rubber belt, as the outer enclosure for a multi-chambered rotary drum. The flexibility of the outer enclosure permits it to conform to the periphery of the rotary drum, including minor imperfections or specialized non-circular configurations.

Further, the flexible belt may be provided as a continuous loop which contacts the outer periphery of the rotary drum for a portion of its rotational distance, thereafter looping back in a continuous fashion over suitable pulleys or other guide means. By permitting or requiring the flexible belt to move in substantial synchrony with the rotary drum, relative movement between the flexible belt outer enclosure and the peripheral surface of the rotary drum may be reduced or eliminated. In this way, problems of providing a sliding seal between the prior art fixed enclosures and the rotary drum are overcome, and problems of wear and mechanical complexity of such sliding seals are eliminated. Movement of the rubber belt in conjunction with the rotary drum may be accomplished either by permitting a passive rubber belt to track and follow the rotary drum by means of friction, or by providing suitable drive means to drive the belt loop as desired.

The preferred embodiment further may include cap securing means for closing the container within the sealed chamber after the desired vacuum or specialized atmosphere has been applied. For example, press-apply lids may be secured by providing plungers attached to pistons passing through suitable sealing gaskets, whereby the plunger descends and presses the lid tightly onto the container at the appropriate time. Other means may similarly be provided, such as means for applying screw lid or crimp-on closures.

In order to retain the contents of the container and prevent the lid from flying off when a vacuum is applied, the closure device such as the plunger described may be, in its retracted position, in proximity to the loosely applied lid when the container is inserted, or it may initially descend to such a first loose cooperating position at a point prior to application of the vaccum. In order to facilitate these operations, a preferred embodiment of the present invention includes an articulated engagement plate on the closure plunger. The articulated plate is biased to a first neutral position at an angle relative to the lid of the container, such that the outer portion of the articulated member is raised to minimize interference with the container and loose-fitting cap during their insertion. The articulated member may pivot to a substantially horizontal position upon contacting the lid of the jar when the plunger is depressed to seal the lid onto the jar, thereby providing even pressure to the lid being applied.

Means such as lost-motion means, may be included to provide a gentle bias to the container lid when the vacuum or other specialized environment is applied. Further, means may be provided for adjusting the length of the closure device to quickly accommodate containers of different height.

BRIEF DESCRIPTION OF THE DRAWINGS

FIG. 8 is a sectional view of a preferred embodiment of substantially continuously flexible belt.

DETAILED DESCRIPTION OF PREFERRED EMBODIMENTS

Figure 1:
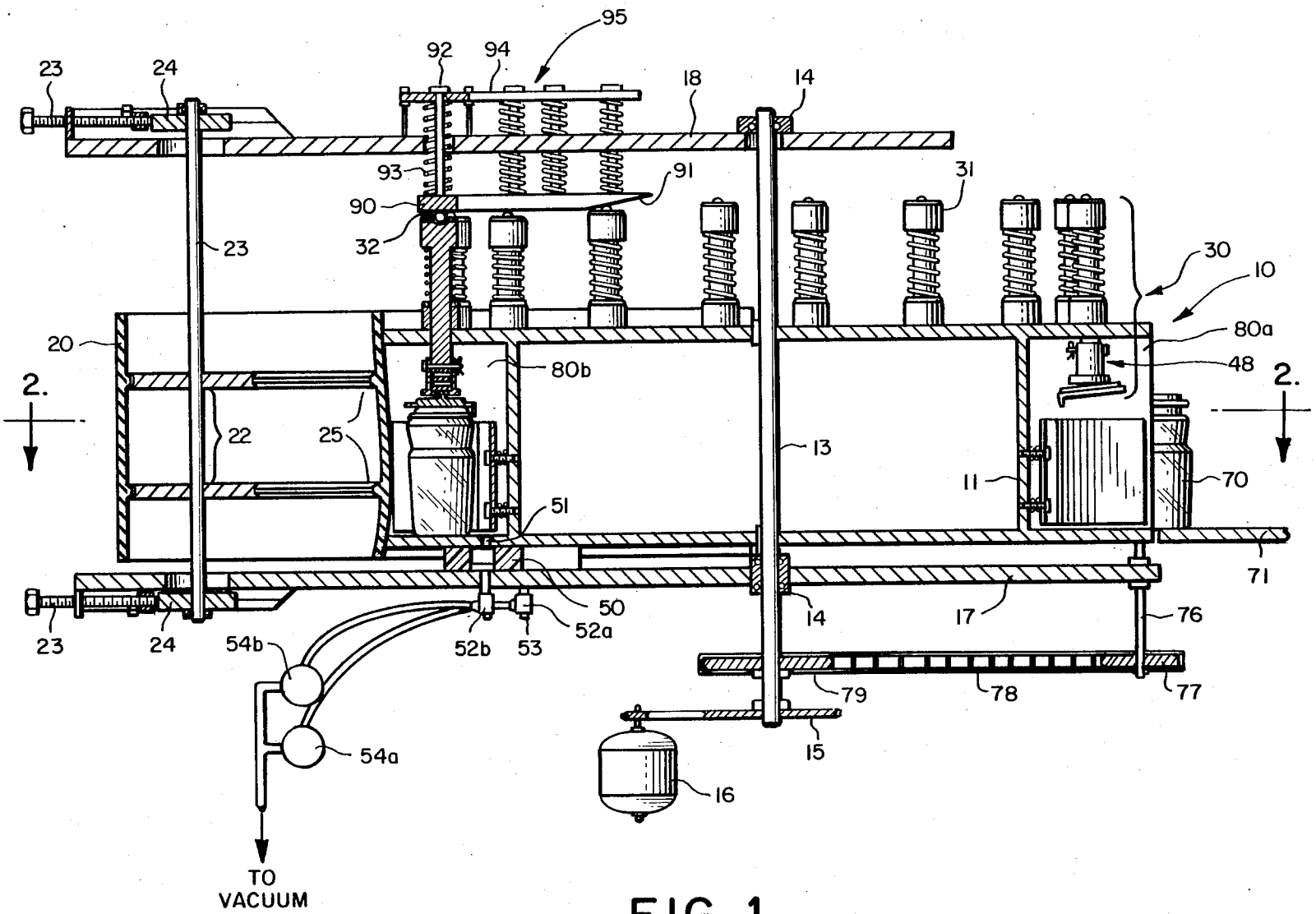
FIG. 1 illustrates a side sectional view of one embodiment of the present invention.

The remaining portion of this specification will describe preferred embodiments of the invention when read in conjunction with the attached drawings, in which like reference characters identify identical apparatus.

Figure 2:
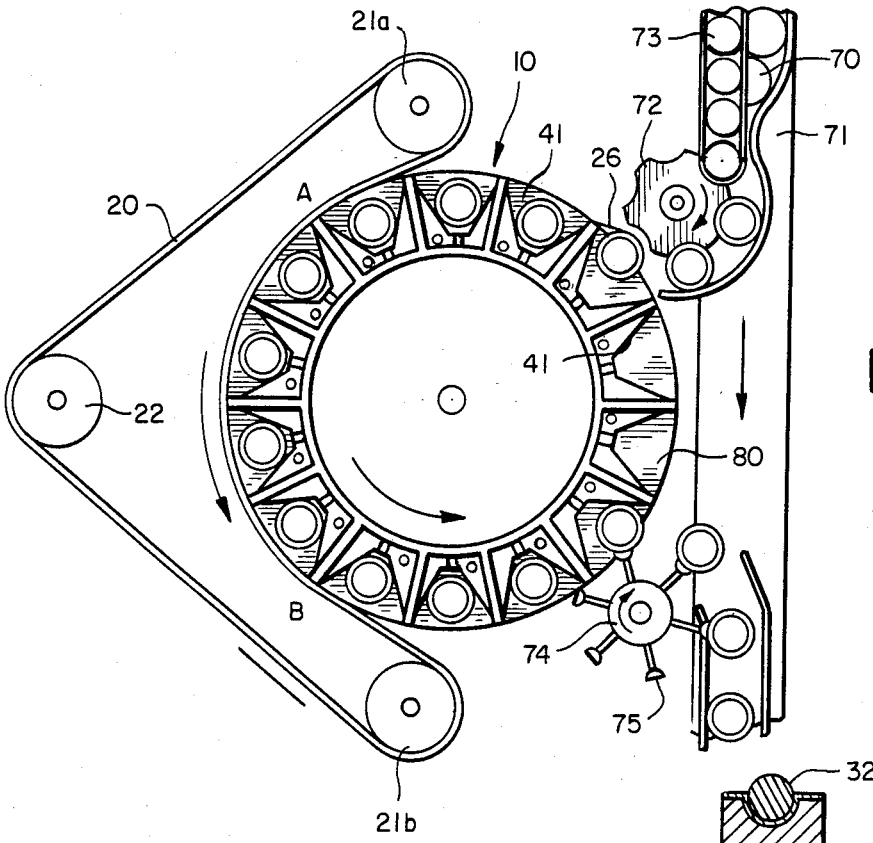
FIG. 2 illustrates a top sectional view of one embodiment of the present invention, indicated generally on FIG. 1.

Referring first to FIG. 2 of the drawings, a sectional view of one preferred embodiment of the present invention is illustrated. A rotary drum 10 is shown having a plurality of individual chambers 80 opening into its outer periphery. A substantially continuously flexible belt 20 is shown in a loop configuration passing around support pulleys 21 and 22. The flexible belt is brought into contact with the a portion of the periphery of rotary drum 10, covering the peripheral openings of the contacted chambers 80 and thereby providing an outer enclosure for the sealed chambers. By "substantially continuously flexible" is meant a belt which is flexible in increments which are at least less than the width of sid peripheral openings of the contacted chambers 80. For simplicity, this is sometimes referred to herein simply as a "flexible belt 20."

In a typical operation, such as vacuum sealing of jars of food products, filled containers 70 are provided by suitable means, such as conveyor belt 71, to insertion means 72 for controlled insertion into empty chambers 80 of the rotary drum 10. In a preferred embodiment, containers 70 are sequentially presented, by means of an accelerating in-feed screw, to insertion means 72 comprising a rotating star wheel. Caps 73 are loosely applied to the containers 70 prior to insertion into the chambers 80 of rotary drum 10. The caps are applied loosely to permit air within the containers to escape when the sealed chambers are later evacuated.

Insertion means 72, cooperating with poly urethane slide 26, causes the containers to be placed substantially within and on the center line of the empty chambers 80 of rotary drum 10. Positioning means 41 may be provided to guide the container 70 into a desired position within chamber 80, facilitating subsequent operations such as closure of the container and removal of the sealed container. Means may be provided for pushing the container 70 into full contact with positioning means 41 to assure proper alignment. However, it has been found that subsequent application of the flexible belt 20 to the periphery of the drum is generally sufficient to assure adequate positioning of the containers 70.

The inserted containers are then transported within individual chambers 80 of rotary drum 10 to a position identified generally by reference letter A in FIG. 2, where flexible belt 20 contacts the periphery of the rotary drum 10. Because of the locations of support pulleys 21*a* and 21*b* relative to the rotary drum 10, flexible belt 20 is maintained in contact with the periphery of rotary drum 10 for an arc defined generally between references letters A and B in FIG. 2. Duing this period of rotation, the flexible belt 20 provides an outer enclosure for chambers 80, substantially sealing them from the outer atmosphere. These sealed chambers may then be evacuated to remove air from the interior of the sealed chambers and consequently the interior of the container. Such evacuation may occur in step-wise fashion if desired as the sealed chambers rotate between general positions A and B as illustrated. Further, it is contemplated that alternate environments may similarly be supplied to the sealed chambers. For example, the chambers may first be evacuated, and subsequently exposed to a desired specialized atmosphere such as an inert gas. Additional vacuum stages, or application of differing gasses, may then be supplied. Such operations are more fully described herein.

After the desired atmosphere has been established in the sealed chambers, means may be activated if desired for sealing and securing the lid of the container to the container itself. The ambient outer atmosphere may then be reintroduced to the sealed chamber, and the flexible belt 20 may be withdrawn from contact with rotary drum 10, such as by means of support pulley 21*b*.

The closed containers are then transported by rotary drum 10 to a position for removal. Removal means 74 is illustrated, comprising a star wheel having suction cups 75 for grasping the container and transporting it to the conveyor 71. It is understood, however, that alternative means for providing the containers 70 to the apparatus, as well as alternative insertion means 72 and removal means 74 known to those of ordinary skill in the art, may similarly be employed, including means readily adaptable to containers of differing configurations and sizes.

In the preferred embodiment, flexible belt 20 is free to rotate in a continuous loop defined by support pulleys 21, 22 and the contacted periphery of rotary drum 10. The belt frictionally engages the periphery of rotary drum 10, and is thereby moved in synchrony with the periphery of drum 10 such that relative motion between the drum periphery and flexible belt 20 is substantially eliminated. This frictional contact is facilitated for embodiments employing reduced-pressure atmospheres, such as those used in conjunction with the vacuum sealing of containers, wherein the greater pressure of the outer atmosphere against the outer surface of flexible belt 20 causes the belt to firmly engage the periphery of rotary drum 10 and provides a high quality seal without need for specialized sliding gaskets or complex enclosure hardware. It should be understood, however, that other configurations are also possible, including means known in the art for driving flexible belt 20 at a desired speed.

Although a circuitry rotary drum 10 is illustrated in FIG. 2, it is understood that the present invention may be practiced with drums having other than substantially circular cross-sections. Because the substantially continuously flexible belt 20 provides an adaptive outer enclosure, imperfections in the outer periphery of the rotary drum 10 may be accommodated. Further, means known in the art may be provided with respect to flexible belt 20 to maintain the desired tension of the belt, and to facilitate contact with the periphery of the drum including such alternative configuration drums. For example, idler wheels, idler tracks, or other guide means may be employed to press the moving flexible belt against the periphery of the rotary drum, particularly where the device is employed in conjunction with specialized atmospheres substantially equal to or greater than ambient atmospheric pressure.

FIG. 1 illustrates a side sectional view of a preferred embodiment of the present device as described. The rotary drum 10, including partitions 11 defining the individual chambers 80, is mounted about axle 13, which is rotatably supported by bearings 14 on upper and lower support frames 18 and 17, respectively. The drum is rotated in the preferred embodiment by motor 16 driving pulley 15 attached to axle 13. It is understood that other means for driving rotary drum 10 may similarly be employed.

Insertion means 72 is attached to an axle 76 which is supported by lower support frame 17. The insertion means 72 is driven in synchrony with the rotation of rotary drum 10 by means of chain 78 cooperating with drive sprocket 79 on the axle 13 of rotary drum 10, and sprocket 77 attached to axle 76 of the insertion means 72. Similar synchronized drive means are provided for removal means 74.

FIG. 1 further illustrates one embodiment of a cap securing means 30 for retaining the loosely applied cap proximate the container opening when a vacuum is applied, and for subsequently sealing the lid to the container. As more fully described herein in connection with FIG. 3, a plunger 48 is provided in conjunction with a sliding piston 31 passing through an opening in the top of chamber 80. The plunger 48 is biased to a first raised position so that the container 70 may be inserted into the chamber 80 below the cap securing means 30. As the rotary drum 10 rotates, a cam follower 32 may engage a cam race 90, which in one embodiment has the shape of a circular arc. An inclined ramp 91 on the cam race 90 depresses the cap securing mean 30 toward the container 70 in chamber 80. The cam race 90 may preferably include strain relief means 95 to limit the amount of pressure applied to the cap securing means 30. In one embodiment, such strain relief may be provided by mounting cam race 90 to sliding mounting shafts 92 passing through a mounting frame 94, and providing biasing means such as springs 93 between the cam race 90 and the mounting frame 94. Other configurations known in the art may similarly be employed.

Chamber 80*b* of FIG. 1 illustrates a chamber holding a container during application of a vacuum. Flexible belt 20 contacts the periphery of the rotary drum 10, sealing the outer opening of chamber 80*b* as previously described. As more fully described herein in connection with FIGS. 4 and 5, a passageway 51 passing between the interior of chamber 80*b* and the exterior of rotary drum 10 rotates into alignment with a source of vacuum applied to sliding seal 50. In a preferred embodiment, seal 50 comprises a polytetrafluoroethylene seal or other seal having a low coefficient of friction, which contacts a suitable surface such as a smooth machined surface on rotary drum 10 to provide a substantially air-tight sliding seal. A source of vacuum may be applied to the space defined by seal 50 by any suitable means known in the art. Multiple seal cavities, as illustrated more fully in FIGS. 4 and 5, may similarly be provided.

Although FIG. 1 illustrates a passageway 51 passing through the bottom surface of rotary drum 10, other configurations are also possible. For example, in a preferred embodiment the passageway passes through the upper surface of the rotary drum 10, and cooperates with a top-mounted sliding seal 45 shown in phantom in FIG. 3. Such upper-surface design avoids problems of ingestion into the vacuum system of debris located on the bottom of the chamber 80, such as material dislodged and expelled from the containers when vacuum is applied. When a lower surface design is chosen, it is preferable to provide cleaing access ports 53 in the connectors 52 so that such debris may be removed.

Also illustrated in FIG. 1 is one embodiment for mounting and guiding flexible belt 20. Specifically, guides 25 may be provided on the inner surface of the flexible belt 20 for cooperating with support pulleys 22.

Figure 7A:
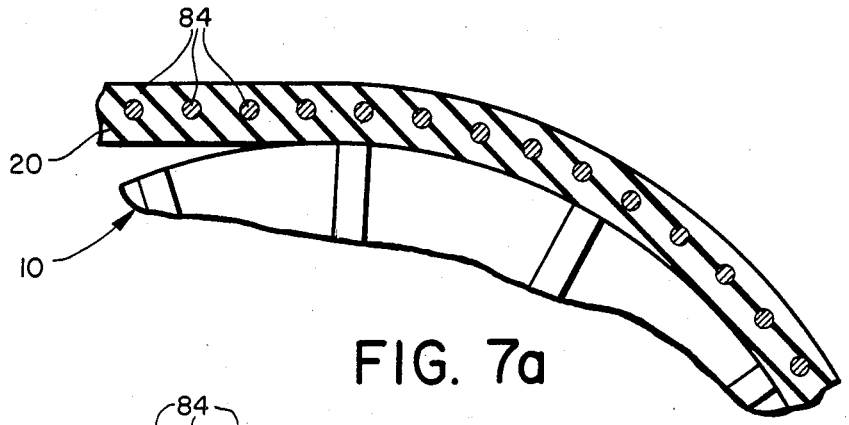
FIGS. 7*a*, 7*b*, and 7*c* are sectional views of alternative embodiments of substantially continuously flexible belts which may be used in conjunction with the present invention.
Figure 7B:
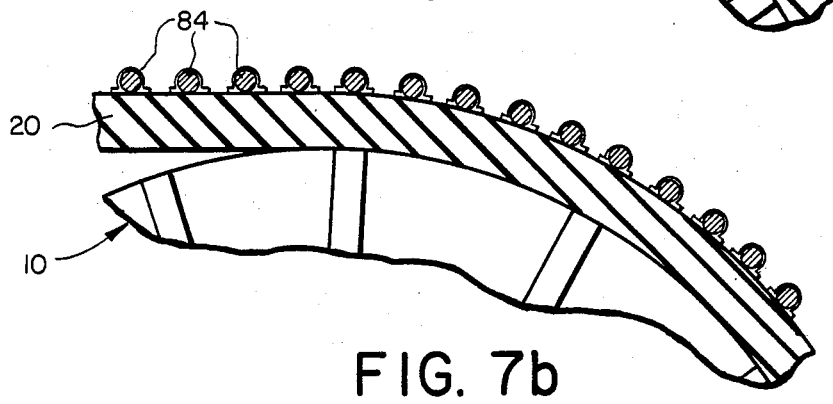
Figure 7C:
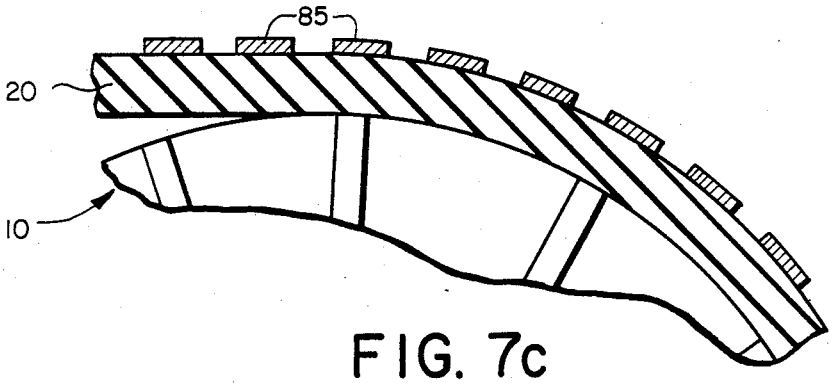
Figure 7D:
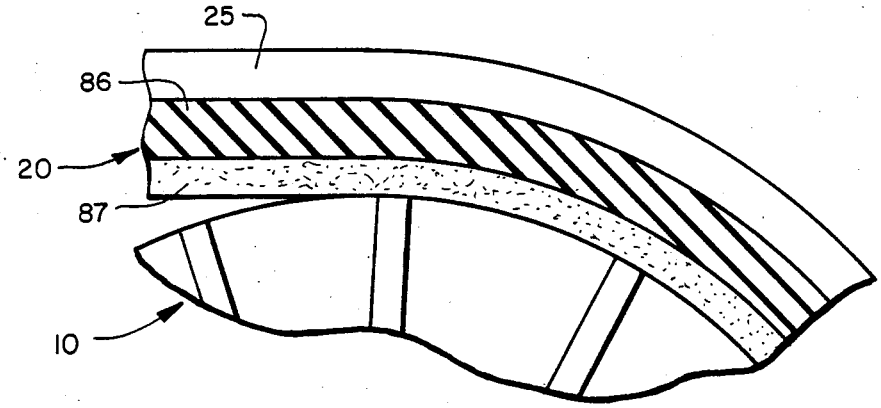

Such a system provides necessary alignment with respect to the surface of rotary drum 10. The guides 25 may additionally provide some stiffness to the flexible belt 20 to minimize distortion of the belt resulting from pressure of the atmosphere on its outer surface when a vacuum is applied to chamber 80*b*. "Such distortion may cause the belt to be drawn into the chamber, as shown. Other optional means for providing stiffening to flexible belt 20 may similarly be employed, such as internal or external stiffening rods 84 or plates 85 which may be perpendicular to the edges of the belt 20, as shown in FIGS. 7*a*, 7*b*, and 7*c*.

Flexible belt 20 itself may comprise numerous suitable materials. For example, belts comprising flexible plastic, rubber, polyvinylchloride or other elastomeric materials may be used, preferably having sufficient tensile strength to resit stretching or rupture in operation. One such material which has been employed in a preferred configuration is a loop comprising FMW-400 plastic belt material distributed by Volta International, Orange, N.J. The ends of the material are joined to form a continuous loop by hot melt techniques known in the art. V-shaped guides are adhered to the outer surface and notched to prevent separation from the belt material when flexed. Three guides are attached in a preferred configuration, although greater or fewer in number could be employed.

Lengths of reinforced PVC belt material, 0.280 inches in thickness, coated on both sides, with internal reinforcing mesh (PVC 280 CBS) have also been employed. The belt material is joined to form a continuous loop by forming a butt splice utilizing PVC adhesive, overlapping the internal reinforcing cords. Other methods for joining the material to form a loop may similarly be used, including angled splices or other splice configurations for spreading the joint stress over a broader section of belt to minimize joint fatigue and wear. V-shaped guides 25, also of a PVC material, may be adhered to the inner surface by means of PVC adhesive. Other forms of flexible belts, such as jointed link belts and wire mesh belts supporting an elastomeric layer wherein individual links are at least narrower than the width of the peripheral openings of the contacted chambers 80 to provide a substantially continuously flexible belt 20, may be used.

Flexible belt 20 may also be provided with more than one layer. In a preferred embodiment illustrated in FIG. 8, flexible belt 20 includes a first inner support layer 86 as described above, such as a reinforced PVC belt with guides 25, as well as a second outer layer 87. The outer layer 87 may preferably comprise a soft, resilient rubber or plastic laminate to fascilitate air-tight contact between the belt 20 and the drum 10. Use of such a laminate has been found to assist in maintaining a secure seal between the flexible belt 20 and the drum 10 when, for example, the belt is distorted as previously discussed by applying a vaccum to chamber 80. One such material that has been employed in a preferred configuration is a 0.25 inch thick laminate of "LINATEX" rubber, manufactured by the Linatex Corporation of America, Stafford Springs, Conn.

In the preferred embodiment, means are provided for maintaining a desired tension in the flexible belt 20 to assure intimate contact with the periphery of rotary drum 10, and to prevent the belt from slipping off of the support pulleys 22. In one embodiment, adjustable bearings 24 are provided which may be moved by means of adjustment bolts 23 to tighten the belt. Other means known in the art for providing desired tension in flexible belt 20 may similarly be employed.

Figure 3:
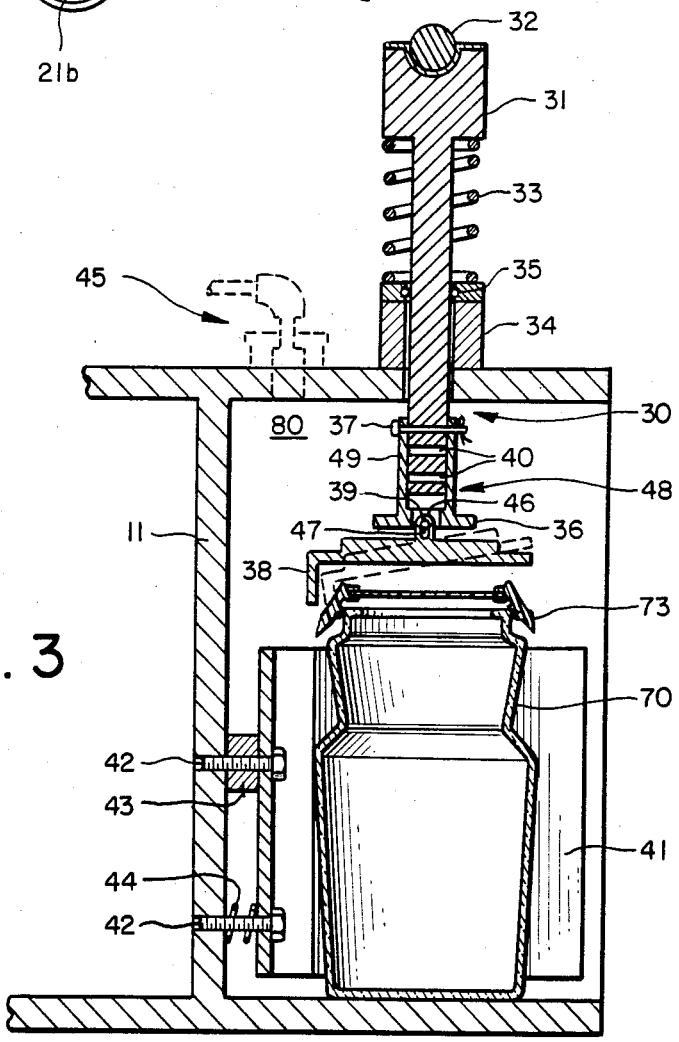
FIG. 3 illustrates a sectional view of one chamber of the drum, including one embodiment of the cap securing means and embodiments of the positioning means.

FIG. 3 shows a sectional detailed view of one chamber 80 including the cap securing means 30. Cap securing means 30 in a preferred embodiment includes a sliding piston 31 which passes through a sleeve bearing 34 into the interior of chamber 80. Sealing means such as O-ring 35 may be provided to assure a substantially air-tight seal. Other sealing means known in the art, such as "Telfon" packing material cooperating with a packing flange, may similarly be employed. Sliding piston 31 is biased to a first, extended position by biasing means such as spring 33.

The cap securing means 30 further includes a plunger 48 for contacting the cap 73 of container 70. In the preferred embodiment illustrated, the attachment means for attaching the plunger 48 to the sliding piston 31 includes a cylindrical sleeve 36 which surrounds the lower portion of sliding piston 31 and is secured thereto by a mounting pin 37. The cap securing means 30 is rapidly adaptable to containers of varying heights by providing a plurality of mounting holes 40 in the lower portion of sliding piston 31 for mounting pin 37.

The plunger 48 further includes in the preferred embodiment an articulated engagement plate 38 attached to the cylindrical sleeve 36 by pivot pin 39. As illustrated in phantom in FIG. 3 and identified by reference letter A therein, the engagement plate 38 is biased to a neutral position in which the front lip proximate the opening in chamber 80 is in a raised position when the container is inserted. In this manner, the vertical tolerances for insertion of the container 70 with cap 73 are improved. The necessary biasing may be provided by any standard means, including proper balancing of the engagement plate 38 itself.

Further, in a preferred embodiment means are provided for permitting a range of lost vertical motion between the sliding piston 31 and the engagement plate 38. Although such lost motion means may be provided at any location in manners known in the art, in a preferred embodiment pivot pin 39 passes through slots 47 in tabs 46 to provide a restricted range of free vertical motion between sliding piston 31 and cylindrical sleeve 36. Sliding piston 31 may then, for example, be depressed by suitable cam race 90 as shown in FIG. 1 to a first partially depressed position after the container is inserted, whereby the pivot pin 39 is within the area of free motion provided by slots 47. In this position, the force applied to the loose cap 73 may be substantially equal to the weight of the engagement plate 38, which gently biases the cap to prevent it from being dislodged when a vacuum is applied, yet permits sufficient motion to allow air within the container to exit and be evacuated. Other biasing means to increase or decrease this pressure may also be employed.

In an alternative embodiment, slots 49 in cylindrical sleeve 36 may cooperate with mounting pin 39 to provide vertical lost motion, such that the unaided bias applied to cap 73 is substantially equal to the weight of the entire plunger 48. Other configurations and combinations are likewise possible.

After the appropriate vacuum or other atmosphere has been supplied, sliding piston 31 may be more fully depressed by suitable cam race 90 and cam follower 32, to apply pressure to cap 73. At such time the engagement plate 38 will pivot to fully contact the upper surface of the cap 73, applying even pressure as necessary. In this manner, press-apply lids, such as the "Tamper- Guard" type cap by Anchor-Hocking, may be applied. It is also anticipated that other means of securing the desired cap to a container may similarly be utilized without departing from the scope of the present invention. For example, means may be provided for securing screw-lid closures, crimp-apply lids, or other closures known in the art.

In order to facilitate alignment of the container 70 beneath the plunger 48, positioning means 41 may be provided inside of chamber 80 as previously discussed. As illustrated in FIG. 3, such positioning means may be secured directly to the back partition 11 of chamber 80, such as by means of mounting bolt 42 and appropriate spacing washer 43. By varying the configuration of positioning means 41 and its mounting, such as by varying the thickness of spacing washer 43, differing diameters of containers may be readily accommodated. In another embodiment, spacing washer 43 may be replaced by a biasing means such as spring 44. In this configuration, positioning means 41 is self-adaptive for receiving larger diameter and smaller diameter containers, and may provide strain relief during the insertion process.

Figure 6B:
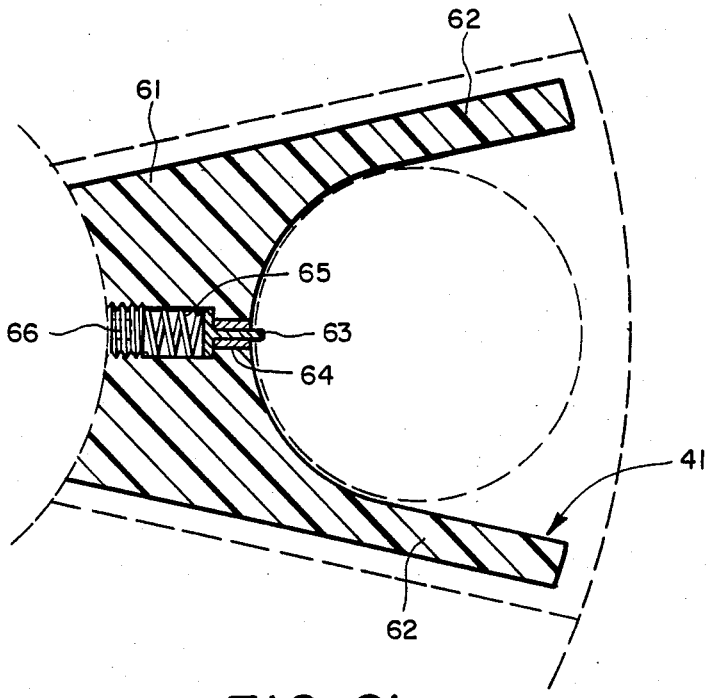
FIG. 6*b* is a side sectional view of one embodiment of a positioning means.
Figure 6A:
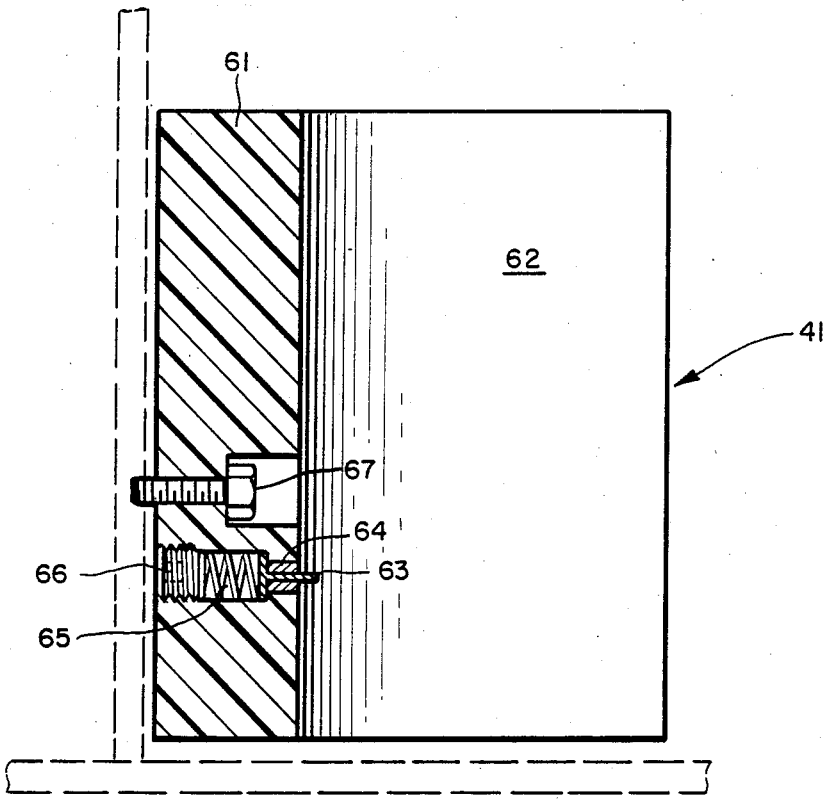
FIG. 6*a* is a top sectional view of one embodiment of a positioning means.

A preferred embodiment of positioning means 41 is illustrated in FIGS. 6*a* and 6*b*. Unlike the thin metal guides 41 illustrated in FIGS. 2 and 3, positioning means 41 in FIGS. 6*a* and 6*b* include a solid body 61 having substantial interior volume, as well as positioning arms 62. When positioned in the chamber 80 shown in phantom, the preferred embodiment occupies a sizable portion of the free space within the chamber, thereby substantially reducing the volume of air which must be evacuated to achieve a desired vacuum and permitting use of lower volume vacuum equipment. The preferred embodiment illustrated includes a recess 67 for mounting bolt 42, and may further include an ejection means for facilitating removal of the container, particularly malformed containers. Specifically, an ejection plunger 63 may be provided which passes through sleeve bearing 64, biased to its extended position by biasing means such as spring 65 retained by set screw 66. When the container is inserted, spring 65 is compressed, and the resulting biasing force assists in subsequent removal of the container.

The vacuum or other atmosphere is supplied in a preferred embodiment to the rotary drum 10 by means of a sliding seal providing a plurality of independent stages of environmental control. Specifically, a sliding seal 50 is mounted between the support frame 17 and the outer surface of rotary drum 10. Passageways 51 pass through the surface of the rotary drum 10 into the interior of chambers 80, aligned radially with plenums 55 of the sliding seal 50. The individual plenums 55 are further connected to environmental sources, such as the vaccum supplies illustrated in FIG. 1, by means of suitable connectors 52.

Figure 4:
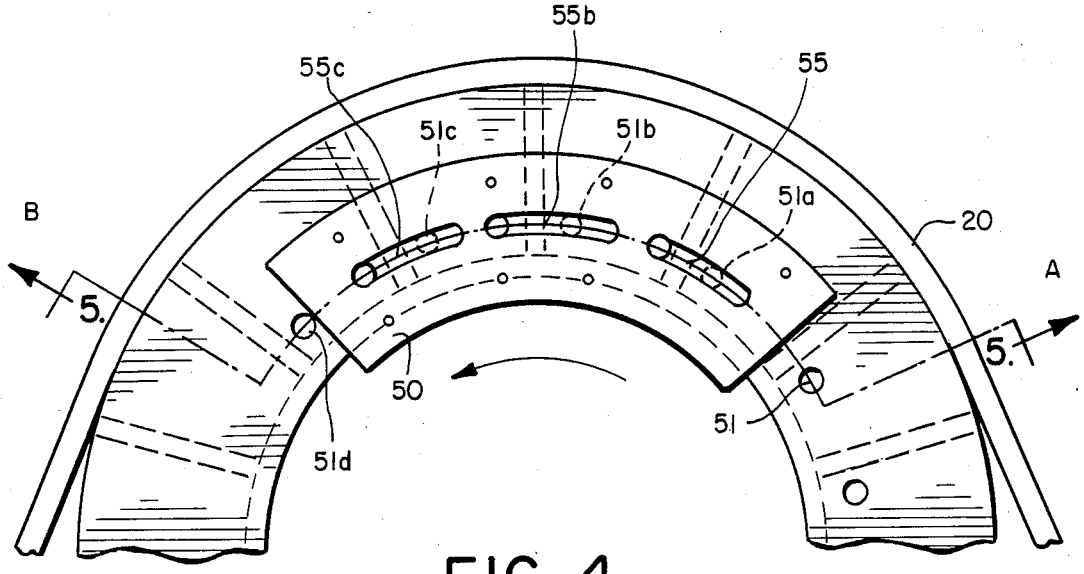
FIG. 4 illustrates one embodiment of a means for introducing vaccum or other desired environments to the sealed chambers of the rotating drum.
Figure 5:
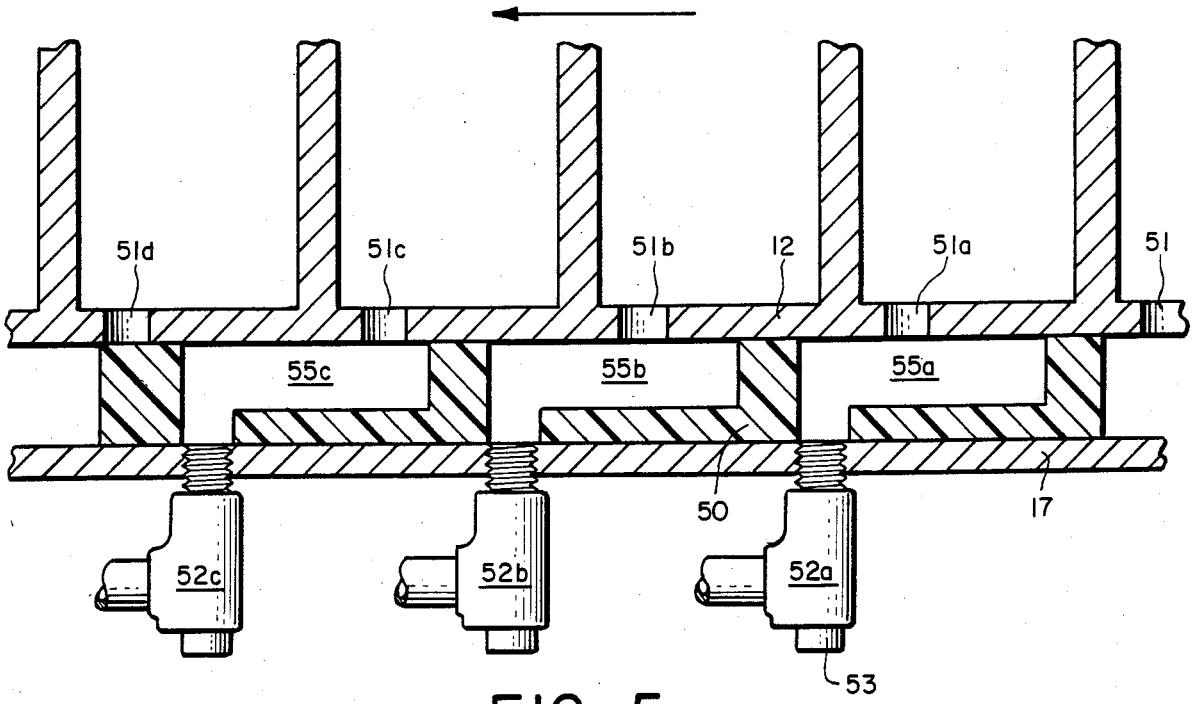
FIG. 5 illustrates a sectional view of one embodiment of the means illustrated in FIG. 4, as indicated generally on FIG. 4.

In operation, the substantially continously flexible belt 20 contacts and fully encloses a given chamber 80 at a point generally identified in FIG. 4 as point A. Thereafter, the passageway 51*a* associated with the sealed chamber passes over and communicates with the plenum 55*a*, exposing the interior of the sealed chamber to an environment defined by the first environmental source. Passageway 51*a* s maintained in communication with plenum 55*a*, until encountering the partition separating plenums 55*a* and 55*b*. After passing across this partition, the passgeway will then communicate with plenum 55*b*, and be exposed to the second environmental source. Similarly, the passageway is finally exposed to the third plenum, 55*c*.

By making the thickness of the partitions separating the individual plenums 55 greater than or equal to the diametr of passageways 51, a substantially complete isolation between individual plenums 55, and therefore between their associated environmental sources, is achieved. Thus, in the multi-stage configuration illustrated, the first environment may, for example, apply a gentle vacuum to reduce the pressure within the chamber while minimizing problems of container contents being dislodged by escaping air, while subsequent stages may apply correspondingly lower pressures to achieve the desired level of vacuum, with the container being sealed during the third and final stage. Alternatively, the first stage may apply a vacuum to evacuate air from the chamber, while subsequent stages supply alternate atmospheres such as an inert gas or an inert flushing gas followed by additional vacuum stages. Individual pressure regulators 54*a*–54*b* known in FIG. 1 may be provided to accomplish the desired sequence, or one or more of the regulators 54 may be replaced by sources of alternate specialized atmospheres or gasses. Other uses are similarly possible.

As the chamber passes from the sliding seal 50, as illustrated by passageway 51*d*, the passageway is exposed again to the outer atmosphere. The chamber is thus returned to atmospheric pressure, so that flexible belt 20 may be easily removed at point B as shown.

It has been found that sliding seal 50 may preferably comprise a polytetrafluoroethylene material having a low coefficient of friction relative to a suitable cooperating surface of the drum such as a polished annular surface. Such a seal does not adversely affect operation of the present invention. The problems associated with prior art enclosures which include large sliding seals are avoided, because the area of contact between the sliding seal 50 and the rotary drum 10 is substantially smaller than the prior art peripheral enclosure seals. Further, the total force and resulting friction generated between the sliding seal of the present invention and the drum when a vacuum is applied is substantially less than the objectionable force associated with prior art enclosures having sliding seals engaging the periphery of the drum, for the present invention permits the total area of plenums 55 to be substantially smaller than the large area of the prior art enclosures which are subjected to the pressure of the atmosphere.

It is understood that alternative sliding seal arrangements known to persons of ordinary skill in the art, including seals of other types or materials, may similarly be employed. Alternate configurations, including fewer or additional stages, may be provided, and the necessary communication between the chambers and the exterior of the drum may be provided at locations other than the specific locations illustrated.

It should be similarly understood that the present invention may be embodied in other specific forms without departing from its spirit or essential characteristics. The present embodiments are, therefore, to be considered in all respects are illustrative and not restrictive. All changes which come within the meaning and range of the equivalents of the claims are, therefore, intended to be embraced therein.

I claim:

1. An apparatus for sequentially exposing objects to a controlled environment, comprising:

a rotary drum having a chamber therein for receiving said object, said chamber opening into the periphery of said rotary drum;

a substantially continuous flexible belt enclosure;

means for supporting said substantially continuous flexible belt enclosure proximate said opening in the periphery of said rotary drum, such that said substantially continuous flexible belt enclosure contacts a portion of the periphery of said rotary drum and periodically covers said opening in the periphery of said rotary drum; and means communicating with said chamber for supplying said controlled environment thereto while said substantially continuous flexible belt enclosure covers said chamber opening in the periphery of said rotary drum.

2. The apparatus of claim 1 wherein said rotary drum is substantially cylindrical.

3. The apparatus of claim 1 wherein said substantially continuous flexible belt enclosure comprises a moving flexible enclosure, said moving flexible enclosure moving in substantial synchrony with the periphery of said rotary drum.

4. The apparatus of claim 3 wherein said moving flexible enclosure comprises an endless closed loop.

5. The apparatus of claim 1 wherein said controlled environment comprises a vacuum.

6. An apparatus for vacuum sealing containers comprising:

a rotary drum;

said rotary drum including a plurality of chambers, said chambers opening into the periphery of said rotary drum;

a moving substantially continuous flexible belt loop;

means for supporting said moving substantially continuous flexible belt loop in contact with a portion of the periphery of said rotary drum, such that said moving substantially continuous flexible belt loop sequentially covers one or more of said chamber openings in the periphery of said rotary drum; and means communicating with said chamber for applying a vacuum thereto while said moving substantially continuous flexible belt loop is covering said chamber openings in the periphery of said rotary drum.

7. The apparatus of claim 6 further comprising means for sealing the container within said chamber while said vacuum is applied to said chamber.

8. The apparatus of claim 7 wherein said chamber includes a top and a bottom surface, and said sealing means comprises:

said top surface including an opening passing through said top surface of said chamber;

a sliding piston having an upper end and a lower end, said sliding piston passing through said opening in said top surface such that said upper end extends above said top surface and said lower end is located within said chamber;

a plunger means for engaging and sealing said container;

means for adjustably attaching said plunger means to said lower end of said sliding piston such that said plunger means is supported above said bottom surface of said chamber a distance equal to or greater than the height of the container;

said adjustable attachment means including means for adjusting the distance between said plunger means and said bottom surface of said chamber to adjust said sealing means for use with containers of different heights; and means copperating with said upper end of said sliding piston for depressing said sliding piston and said plunger means relatively toward said bottom surface of said chamber such that said plunger means engages said container.

9. The apparatus of claim 8 wherein said adjustable attachment means includes lost motion means for permitting a restricted range of relatively free travel in the direction of the axis of said sliding piston between said sliding piston and said plunger means.

10. The apparatus of claim 8 wherein said plunger means further comprises:

an engagement plate having a front portion nearest to said chamber opening in the periphery of said rotary drum, and a back portion farthest from said chamber opening in the periphery of said rotary drum;

means for pivotally attaching said engagement plate to the surface of said plunger means nearest to said bottom surface of said chamber;

said engagement plate pivotably movable between a first position defining an acute angle with respect to said bottom surface of said chamber whereby said front portion is raised with respect to said back portion, and a second position substantially parallel to said bottom surface of said chamber; and means for biasing said engagement plate to said first position.

11. The apparatus of claim 8 wherein said depressing means comprises:

a cam follower, said cam follower attached to said upper end of said sliding piston; and a cam race, said cam race supported above said rotary drum such that said cam follower contacts said cam race thereby depressing said sliding piston relatively toward said bottom surface of said chamber.

12. The apparatus of claim 7 wherein said container sealing means comprises:

an engagement plate for engaging and sealing said container;

engagement plate support means, said engagement plate support means located within said chamber;

lost-motion means for attaching said engagement plate to said engagement plate support means, such that a restricted range of relatively free travel in a direction substantially perpendicular to said engagement plate is permitted between said engagement plate and said engagement plate support means; and means cooperating with said engagement plate support means for depressing said engagement plate support means and said engagement plate relatively toward the bottom surface of said chamber such that said engagement plate engages said container.

13. The apparatus of claim 7 further comprising means for inserting said containers into said chambers, and means for removing said containers from said chambers.

14. The apparatus of claim 6 further comprising means for restraining and positioning said containers within said chambers.

15. A method for sequentially exposing objects to a controlled environment, comprising the steps of:

inserting said objects into a chamber which opens into the periphery of a rotary drum;

contacting a portion of the periphery of said rotary drum with a substantially continuous flexible belt enclosure, such that said substantially continuous flexible belt enclosure periodically covers said opening in the periphery of said rotary drum to provide a substantially air-tight closure of said chamber;

introducing the controlled environment to the interior of said chamber after said object has been inserted and after said opening in the periphery of said rotary drum has been covered and substantially sealed by said substantially continuous flexible belt enclosure;

removing said substantially continuous flexible belt enclosure from contact with the periphery of said rotary drum, thereby uncovering said opening in the periphery of said drum; and removing said object from said chamber.

16. The method of claim 15 wherein said substantially continuous flexible belt enclosure comprises an endless closed loop, and wherein said method further comprises the step of moving said endless closed loop at a speed substantially equal to the peripheral speed of said rotary drum, such that said endless closed loop contacts and moves in substantial synchrony with the periphery of said rotary drum for a portion of the rotation of said rotary drum.

17. The method of claim 15 further comprising the steps of:

inserting a container to be sealed into said chamber;

sealing said container within said chamber after said controlled environment has been provided and before said substantially continuous flexible belt enclosure is removed from contact with the periphery of said rotary drum; and removing the sealed container.

18. The method of claim 17 wherein said controlled environment comprises a vacuum.

19. The apparatus of claim 1 wherein said substantially continuous flexible belt enclosure comprises a first layer for providing mechanical support, and a second resilient layer for contacting the periphery of said rotary drum.

20. The apparatus of claim 6 wherein said moving substantially continuous flexible belt loop comprises a first layer for providing mechanical support, and a second resilient layer for contacting the periphery of said rotary drum.

21. The method of claim 15 wherein said step of contacting a portion of the periphery of said rotary drum with a substantially continuous flexible belt enclosure to provide a substantially air-tight closure of said chamber, further includes the step of providing said substantially continuous flexible belt enclosure with a resilient layer for contacting the periphery of said rotary drum to fascilitate said substantially air-tight closure.

* * * * *

UNITED STATES PATENT AND TRADEMARK OFFICE

CERTIFICATE OF CORRECTION

PATENT NO. : 4,658,566

DATED : April 21, 1987

INVENTOR(S) : John E. Sanfilippo

It is certified that error appears in the above-identified patent and that said Letters Patent is hereby corrected as shown below:

IN THE BACKGROUND OF THE INVENTION

In column 1, line 48, please delete "and" and substitute therefor --an--. (2nd occurrence)

IN THE DETAILED DESCRIPTION OF PREFERRED EMBODIMENTS

In column 4, line 21, please delete "sid" and substitute therefor --said--.

In column 4, line 58, please delete "Duing" and substitute therefor --During--.

In column 5, line 44, please delete "circuitry" and substitute therefor --circular--.

In column 6, line 63, please delete "cleaing" and substitute therefor --cleaning--.

In column 7, line 17, please delete "resit" and substitute therefor --resist--.

In column 8, line 10, please delete "'Telfon'" and substitute therefor --"Teflon"--.

UNITED STATES PATENT AND TRADEMARK OFFICE

CERTIFICATE OF CORRECTION

PATENT NO. : 4,658,566

DATED : April 21, 1987

INVENTOR(S) : John E. Sanfilippo

It is certified that error appears in the above-identified patent and that said Letters Patent is hereby corrected as shown below:

In column 9, line 64, please delete "s" and substitute therefor --is--.

In column 9, line 67, please delete "passgeway" and substitute therefor --passageway--.

In column 10, line 5, please delete "diametr" and substitute therefor --diameter--.

In column 10, line 62, please delete "are" and substitute therefor --as--.

Signed and Sealed this

Twelfth Day of September, 1989

*Attest:*

DONALD J. QUIGG

*Attesting Officer*

*Commissioner of Patents and Trademarks*